US009206620B2

(12) United States Patent
Karsil et al.

(10) Patent No.: US 9,206,620 B2
(45) Date of Patent: Dec. 8, 2015

(54) ALARM INCORPORATED CYLINDER LOCK

(71) Applicant: KALE KILIT VE KALIP SANAYII A.S., Güngören, Istanbul (TR)

(72) Inventors: Feramuz Karsil, Istanbul (TR); Ahmet Bilgic, Istanbul (TR); Kadir Icibal, Istanbul (TR)

(73) Assignee: KALE KILIT VE KALIP SANAYII A.S., Güngören, Istanbul (TR)

( * ) Notice: Subject to any disclaimer, the term of this patent is extended or adjusted under 35 U.S.C. 154(b) by 0 days.

(21) Appl. No.: 14/435,817

(22) PCT Filed: Apr. 30, 2013

(86) PCT No.: PCT/EP2013/058972

§ 371 (c)(1),
(2) Date: Apr. 15, 2015

(87) PCT Pub. No.: WO2014/060119

PCT Pub. Date: Apr. 24, 2014

(65) Prior Publication Data

US 2015/0284975 A1 Oct. 8, 2015

(30) Foreign Application Priority Data

Oct. 19, 2012 (EP) ..... 12189306

(51) Int. Cl.
*E05B 15/16* (2006.01)
*E05B 9/04* (2006.01)
(Continued)

(52) U.S. Cl.
CPC ..... *E05B 9/041* (2013.01); *E05B 17/0058* (2013.01); *E05B 45/06* (2013.01);
(Continued)

(58) Field of Classification Search
CPC ..... E05B 9/041; E05B 9/042; E05B 17/0054; E05B 17/0058; E05B 17/0062; E05B 45/00; E05B 45/06; E05B 2045/065; E05B 2045/0665; Y10S 70/49; Y10S 70/60; Y10T 70/20; Y10T 70/25; Y10T 70/7949; Y10T 70/8027
USPC ..... 70/1.5, 1.7, 422, DIG. 49, DIG. 60, 70/DIG. 63, 432, DIG. 59, 372, 416, 373, 70/DIG. 30; 340/542
See application file for complete search history.

(56) References Cited

U.S. PATENT DOCUMENTS 4,074,547 A * 2/1978 Seidewand ..... 70/1.5
4,074,548 A * 2/1978 Milton ..... 70/1.5
(Continued)

FOREIGN PATENT DOCUMENTS

DE 7531378 U 5/1976
DE 8308613 U1 6/1983
(Continued)

*Primary Examiner* — Lloyd Gall
(74) *Attorney, Agent, or Firm* — Epstein Drangel LLP; Robert L. Epstein

(57) ABSTRACT

A cylinder lock having a first cylinder half, which in use, is mounted on the indoor side and a second cylinder half, which in use, is mounted on the outdoor side of a door, is disclosed. The cylinder lock further comprises a notch cut out on the outdoor end of the second cylinder half for forming a breakable tip portion on the second cylinder half. A rod extends along the second cylinder half and enters, partly at its first end, in the first cylinder half. The rod is secured, at its second end, to the tip portion of the second cylinder half. The cylinder lock further comprises a volume formed on the first cylinder half for accommodating an alarm circuitry including at least an electronic circuit board, a magnetic switch and a magnet.

9 Claims, 10 Drawing Sheets

(51) Int. Cl.
*E05B 17/00* (2006.01)
*E05B 45/06* (2006.01)

(52) U.S. Cl.
CPC ..... *E05B2045/0665* (2013.01); *Y10S 70/49* (2013.01); *Y10S 70/60* (2013.01); *Y10T 70/20* (2015.04); *Y10T 70/25* (2015.04); *Y10T 70/7949* (2015.04); *Y10T 70/8027* (2015.04)

(56) References Cited

U.S. PATENT DOCUMENTS 4,961,328 A * 10/1990 Mundhenke ..... 70/1.5
5,186,031 A * 2/1993 Janssen et al. ..... 70/277
5,229,747 A * 7/1993 Zhao ..... 340/542
6,334,347 B1 * 1/2002 Iscla ..... 70/278.3
2008/0284595 A1 * 11/2008 Buchhalter ..... 340/545.2
2011/0174030 A1 * 7/2011 Rogers et al. ..... 70/490
2011/0265527 A1 * 11/2011 Saari ..... 70/91
2013/0233031 A1 * 9/2013 Maltaverne et al. ..... 70/1.5

FOREIGN PATENT DOCUMENTS

DE 4104042 C1 5/1992
DE 10325731 A1 12/2004
EP 1707712 B1 6/2010
WO 03093612 A1 11/2003
WO 2009093090 A1 7/2009

* cited by examiner

A-A ( 1 : 1 )

ALARM INCORPORATED CYLINDER LOCK

TECHNICAL FIELD OF THE INVENTION

The present invention relates to a high security cylinder lock having an alarm circuitry for indicating attempts of lock snapping. The proposed cylinder lock is able to generate at least an audible alarm signal in result of a lock snapping attempt and also is able to withstand the lock snapping attempt.

BACKGROUND OF THE INVENTION

Lock snapping is a frequently used technique for breaking in a locked place. Typically a burglar obtains a device for snapping the outer end of a double cylinder lock and then applies a torque, usually in the vertical direction if not in combination to both vertical and horizontal directions. The weakest point in a double cylinder lock is the hole usually in the middle of the two cylinder halves, said hole drilled right below the plug for securing the cylinder lock to the door. Once the burglar applies torque to the snap device, the cylinder lock breaks apart and the two broken cylinder halves separate from each other. The cylinder half on the outer side of the door remains on the snap device whereas the cylinder part on the inner side is pushed by the burglar to fall towards the inside of the door. The burglar then inserts a new cylinder lock into the hole and easily opens the lock with his own key. An alternative is to force the deadbolts be received in the body of the lock through use of an L-shaped tool.

EP 2 208 839 relates to a high security lock cylinder with a pre-determined breaking line intended for breaking during a lock snapping attempt. Said line is mechanically weakened to be ruptured in response to a breaking force applied by a snapping tool. When the cylinder lock is broken as a result of an attack, the bridge between the two cylinder halves remains intact and malicious removal of the lock cylinder is prevented. The remaining part of the attacked cylinder is still able to receive the key thus allowing the original key holder still able to lock and unlock the cylinder lock.

DE 10 325 731 relates to an alarm trigger for lock cylinders against unauthorized break-in attempts. The cylinder lock has non-conductive means between two electrically conductive means in a casing which only produces trigger contact when broken or deformed. When the lock cylinder is broken at the bridging part in between the two cylinder halves or it is removed from its dedicated location, the conductive means of the assembly instantly get in contact and thus an alarm signal is triggered. Said assembly does still not prevent the unauthorized person from entering the building, nor does it allow the subsequent use of the original key of the authorized person in order to unlock and lock the door even after the lock snapping attack. Hence, it is a must that the cylinder lock shall be replaced by a new cylinder lock after each and every lock snapping attack. A further disadvantage is the fact that the unauthorized person may enter the building after lock snapping attack and then destroy, deactivate or de-energize the alarm arrangement. Additionally, this device requires an uninterrupted power supply and montage of conductive cables and specifically trained montage personnel. More important than all, the functionality of this assembly seriously relies on a metal part which is subject to metal fatigue in time.

DE 3 913 204 relates to a cylinder lock core protection device which has an outer drilling protection shield for detection of an unauthorized attempt. The unauthorized person may still enter the building after a lock snapping attack, and may then deactivate or destroy the alarm arrangement.

DE 83 08 613 relates to a lock with electrical tapping-alarm signaling device, its housing and a bolt member. The assembly comprises a cover for the alarm triggering mechanism, which is naturally bigger than the lock cylinder itself. Thus said assembly requires an off-size montage space in the door body.

WO 2009/093 090 relates to a signaling device for burglary prevention system with electrical body lock sensors placed on the cylinder lock insert joining an alarm system through wires. This assembly requires an uninterrupted power supply and montage of conductive cables and is not suitable for use in existing doors.

DE 4 104 042 relates to a core protector for a cylinder lock, incorporating a blade directed towards cylinder core for cutting a conducting foil in order to trigger an alarm mechanism. Attempted entry drilling forces push the rosette backwards along bars and the blade cuts the foil, thereby triggering an alarm.

OBJECTS OF THE INVENTION

An object of the present invention is to provide a cylinder lock which comprises an alarm circuitry located inside the cylinder body for facilitating installation to existing doors.

Another object of the present invention is to provide an alarm incorporated cylinder lock which triggers during a lock snapping attempt.

Another object of the present invention is to provide an alarm incorporated cylinder-lock which is operational even after a successful lock snapping attempt.

SUMMARY OF THE INVENTION

A cylinder lock having a first cylinder half, which in use, is mounted on the indoor side and a second cylinder half, which in use, is mounted on the outdoor side of a door, is disclosed. The cylinder lock further comprises a notch cut out on the outdoor end of the second cylinder half for forming a breakable tip portion on said second cylinder half. A rod extends along the second cylinder half and enters, partly at its first end, in the first cylinder half. The rod is secured, at its second end, to the tip portion of the second cylinder half. The cylinder lock further comprises a volume formed on said first cylinder half for accommodating an alarm circuitry including at least an electronic circuit board, a magnetic switch and a magnet. The first end of the rod is interposed between the magnetic switch and the magnet of the alarm circuitry such that when the tip portion of the second cylinder half breaks apart, the rod slides out of the first cylinder half for detection of a break-in attempt.

The cylinder lock according to the invention may further comprise, within the second cylinder half, a spring loaded block pin for blocking the gap of said rod once the rod slides out of said second cylinder half such that re-insertion of said rod is eliminated. If the gap of the rod remains vacant, it may be possible that the alarm may be de-activated by inserting a thin metal object, or back inserting the rod itself, into the gap and filling the volume in between the magnet and the magnetic switch.

BRIEF DESCRIPTION OF THE FIGURES

Accompanying drawings are given solely for the purpose of exemplifying a cylinder-lock whose advantages over prior art will be explained in detail hereinafter.

DETAILED DESCRIPTION OF THE INVENTION

Figure 1A:
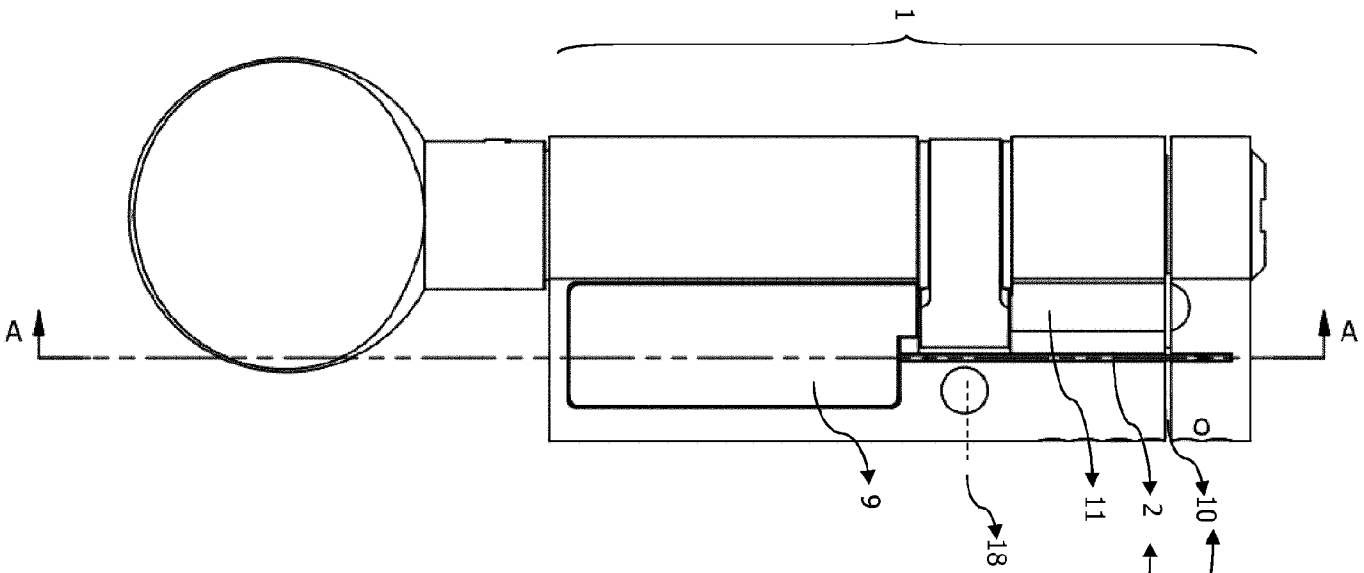
FIG. 1 demonstrates a side view (a) and cross-section A-A (b) of an embodiment of the cylinder lock according to the present invention.

The present invention overcomes the above-mentioned shortcomings of the prior art by way of incorporating an alarm circuitry inside the body of a cylinder lock where said cylinder lock has a pre-determined breaking line for installation on the outer part of a door. The present invention therefore provides an alarm triggering cylinder lock which remains operational even after a successful lock snapping attack. The core idea underlying the present invention is to provide a cylinder lock;

- which will withstand a lock snapping attack,
- which will scare the unauthorized person during and after said attack and thereby force him to cease the attack, and
- which will remain intact and operational even if the attack turns out to be successful and part of the cylinder is broken apart.

The cylinder lock according to the present invention therefore eliminates the need for an additional locksmith work after a lock snapping attack. A new cylinder lock may be installed easily by way of unscrewing the securing bolt, replacing a new cylinder lock and then screwing the securing bolt back in place.

The present invention additionally provides an alarm signaling device which can be installed inside the body of a cylinder lock, thus preventing necessities of extra space to be opened or drilled in the door body and of additional alarm indication means, such as an audio source, a buzzer etc. The present invention may further provide a cylinder lock which is suitable for communicating with other alarm systems which may suitably be found in place. Even though the well-known motion detectors or magnetic contact sensors of existing alarm systems may not alert during a lock snapping attack, the cylinder lock of the present invention allows, in real time, dissemination of attack information with the surrounding alarm systems.

Figure 1B:
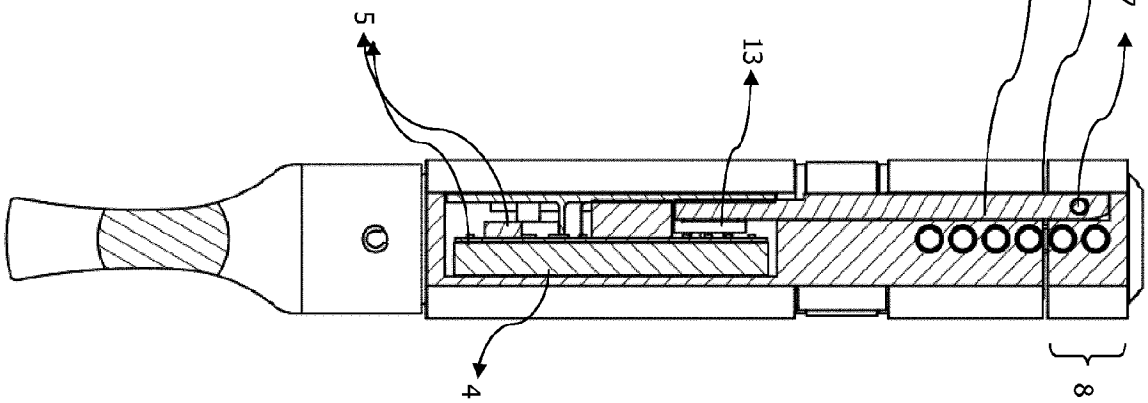
Figure 2A:
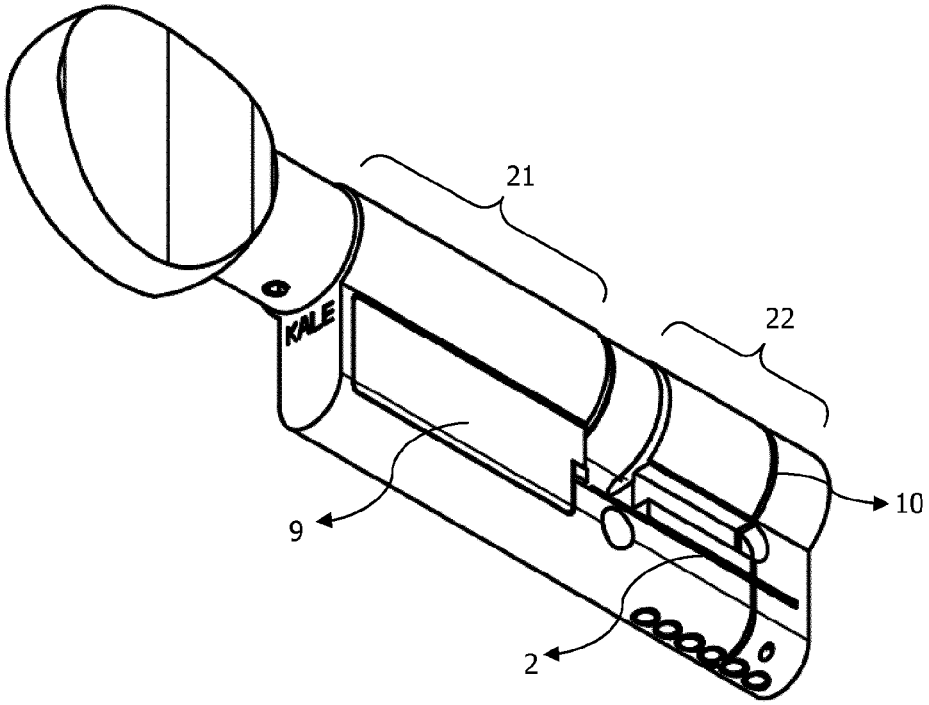
FIG. 2 demonstrates a rear perspective view (a) and front view (b) of the first embodiment of the cylinder lock according to the present invention.
Figure 2B:
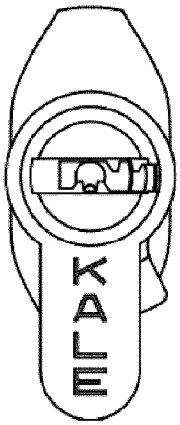
Figure 3A:
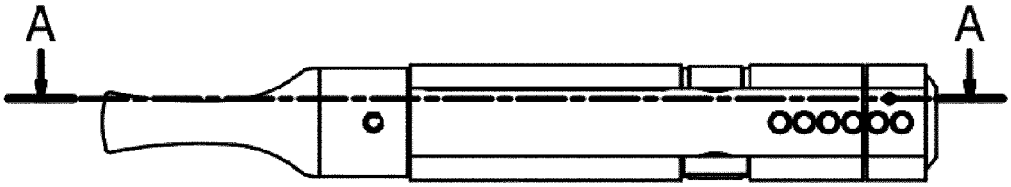
FIG. 3 demonstrates a bottom view (a), a side view (b) and cross-section A-A (c) of the first embodiment of the cylinder lock according to the present invention.
Figure 3B:
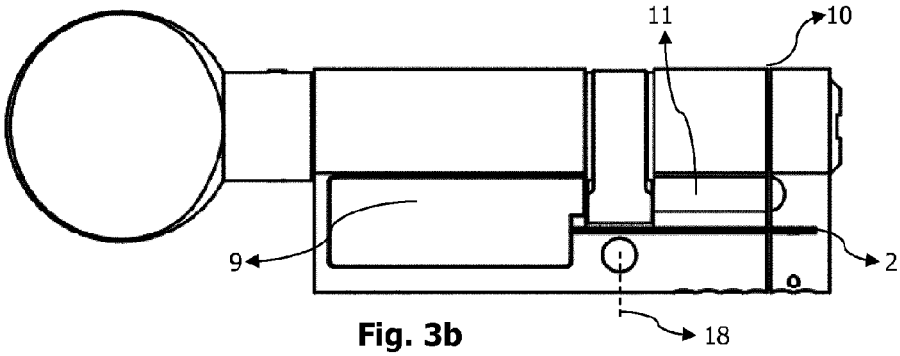
Figure 3C:
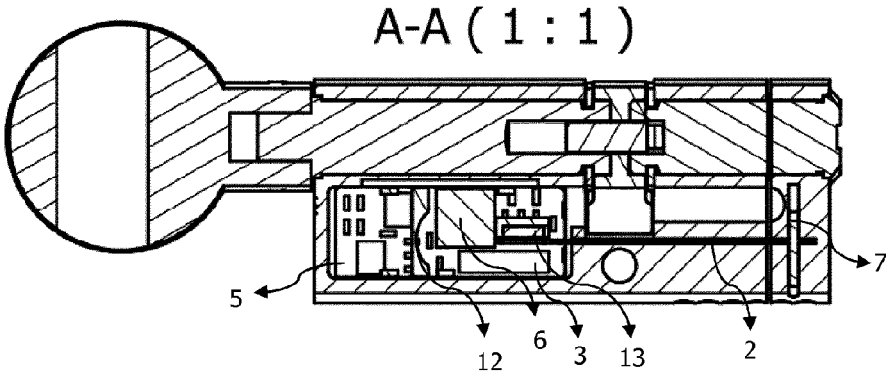

The following reference numerals have used in the appended drawings;

(1) cylinder lock body
(2) rod
(3) magnetic switch
(4) battery
(5) electronic circuit board
(6) buzzer
(7) anchor pin
(8) tip portion
(9) cover
(10) notch
(11) sonic outlet channel
(12) echo surface
(13) magnet
(14) connector
(15) cable
(16) external connection apparatus
(17) external buzzer box
(18) bridge
(21) first cylinder half
(22) second cylinder half
(23) block pin In a first embodiment shown in FIGS. 1, 2 and 3; the cylinder lock body (1) comprises an alarm circuitry located in the first cylinder half. The cylinder lock body (1) comprises two plugs connected by a cam. The cylinder lock body (1) has a first cylinder half (21) for mounting on the indoor part of a door and a second cylinder half (22) for mounting on the outdoor part of a door. In all drawings attached to this specification, the first cylinder half intended for indoor part has alarm circuitry and no tumbler pins whereas the second cylinder half intended for outdoor side has a plurality of tumbler pins. The cylinder (1) in the appended drawings is a Euro profile whereas the invention may be applied to other types of cylinders as well.

The second cylinder half (22) according to the present invention has a notch (10) in the form of a partial cut out which is intended to break during a snapping attempt. The purpose for cutting a notch (10) is to prevent breaking of the bridge (18) and to prevent breaking apart of the first and second cylinder halves. Once the cylinder is snapped from the second part, the snapping tool would snap the tip portion (8) of the second cylinder half (22) and break it apart without jeopardizing the bridging portion in between the first and second cylinder halves.

A rod (2) made of a metallic material is fixed by an anchor pin (7) in the tip portion (8) of the second cylinder half (22) in order to obtain a firm attachment between the rod (2) and tip portion (8). The metallic rod (2) extends along the body of the second cylinder half (22) and enters partly in the first cylinder half (21) where the alarm circuitry is located. It is important however that the metallic rod is secured to the tip portion (8) of the second cylinder half (22) since it has to slide out of the cylinder body if or when the tip portion breaks apart in result of a snapping attempt. Part of the rod (2) which extends inside the first cylinder half (21) remains in between a magnetic switch (3) and a magnet (13) located in said first part. Under normal operating conditions, part of said rod (2) is always interposed between the magnet (13) and the magnetic switch (3) such that the magnetic switch (3) cannot sense the magnet (13) located opposite said magnetic switch (3). The existence of the rod (2) between the magnet (13) and the magnetic switch (3) ensures that the alarm is not triggered.

The first cylinder half (21) has a volume for containing various components of the alarm circuitry. These include at least an electronic circuit board (5), a buzzer (6), a battery (4), a magnetic switch (3) and a magnet (13). This volume is depicted like a rectangular prism in the appended drawings. Conveniently, the volume is closed by a cover (9) in order to protect the electronic circuitry contained therein.

The magnetic switch (3) may be a reed switch located suitably for sensing the motion of the metallic rod (2) during a lock snapping attack. As the metallic rod (2) is secured to the tip portion (8) of the second cylinder half (22), the rod slides initially out of the first cylinder half (21) when the tip portion (8) breaks apart. As the position of the rod (2) between the switch (3) and magnet (13) changes and eventually the rod completely slides out of the interspace, this is sensed by the switch and an alarm is triggered. An audible signal is then released by a buzzer (6).

In order to increase the intensity of the sound generated by the buzzer (6), an echo surface (12) is formed on the cover (9). The echo surface is concave arc form such that the sound generated by the buzzer (6) is directed towards to the second cylinder half (22) whose tip portion (8) is detached. Additionally, a sonic outlet channel (11) is formed on the second cylinder half (22) for conveying the sound waves from the buzzer to the outlet of the second cylinder half. The person making the lock snapping attack hears the sound more intensely since the sound waves are localized in the sonic outlet channel (11).

Figure 4A:
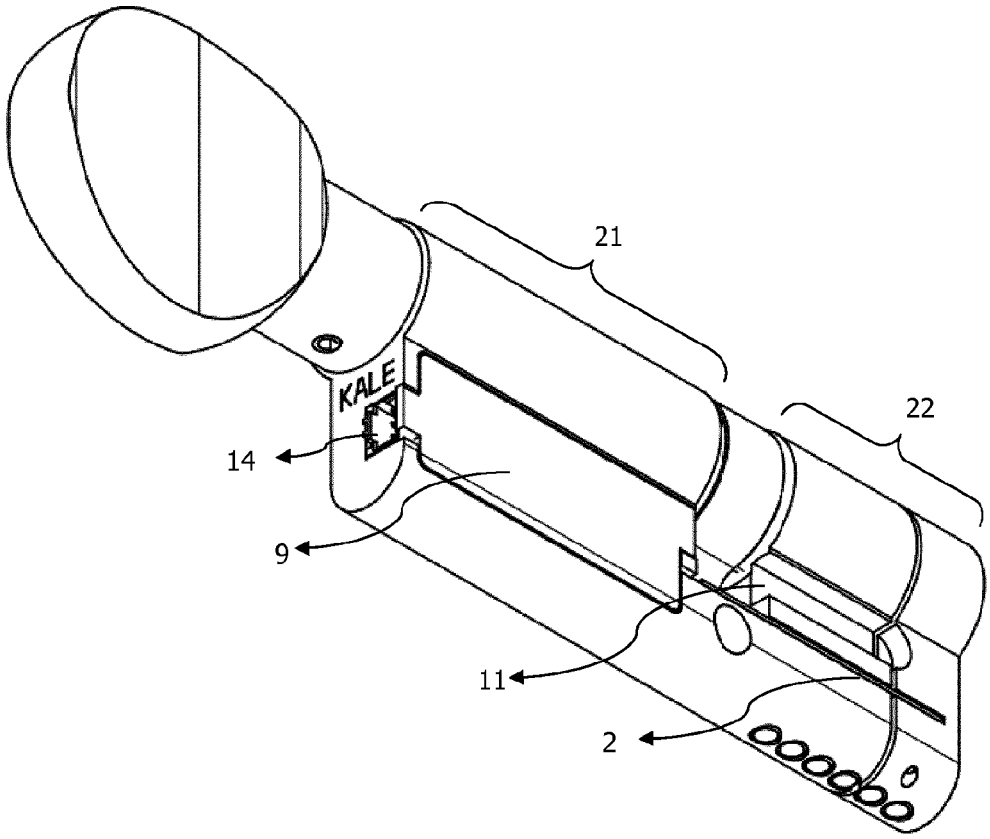
FIG. 4 demonstrates a rear perspective view (a) and front view (b) of a second embodiment of the cylinder lock according to the present invention.
Figure 4B:
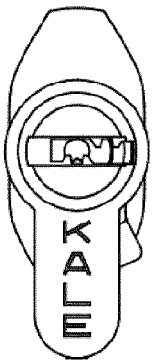
Figure 5A:
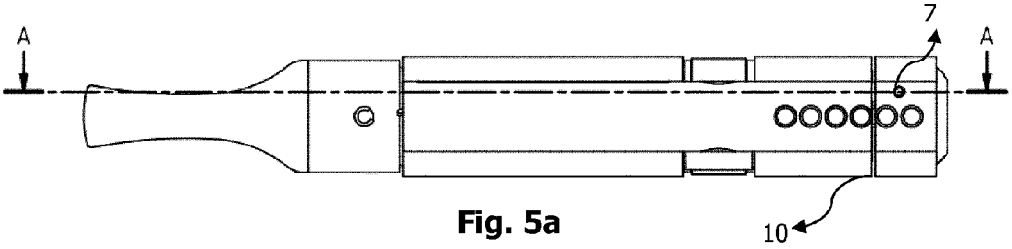
FIG. 5 demonstrates a bottom view (a), a side view (b) and cross-section A-A (c) of the second embodiment of the cylinder lock according to the present invention.
Figure 5B:
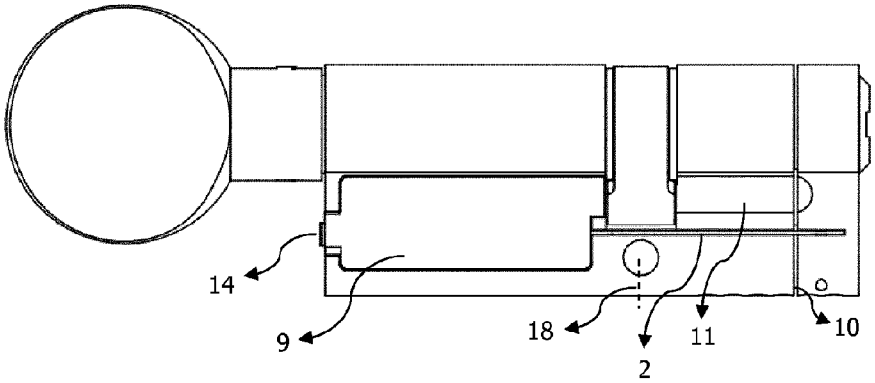
Figure 5C:
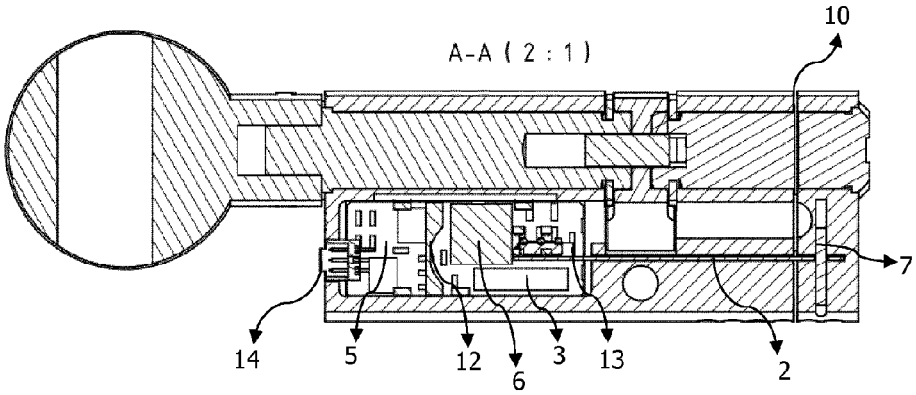

A second embodiment shown in FIGS. 4 and 5 varies from the first embodiment by the fact that the first cylinder half (21) is equipped with a connector (14) for transmitting data from the electronic circuit board (5) to the periphery, such as an alarm system found in the building or the flat. In this case, the cylinder need not to have a buzzer (6) and/or a battery (4), as these two components may conveniently be placed outside the cylinder, e.g. on the inner surface of the door. The connector (14) may be used to transmit not only data but also energy.

Figure 6:
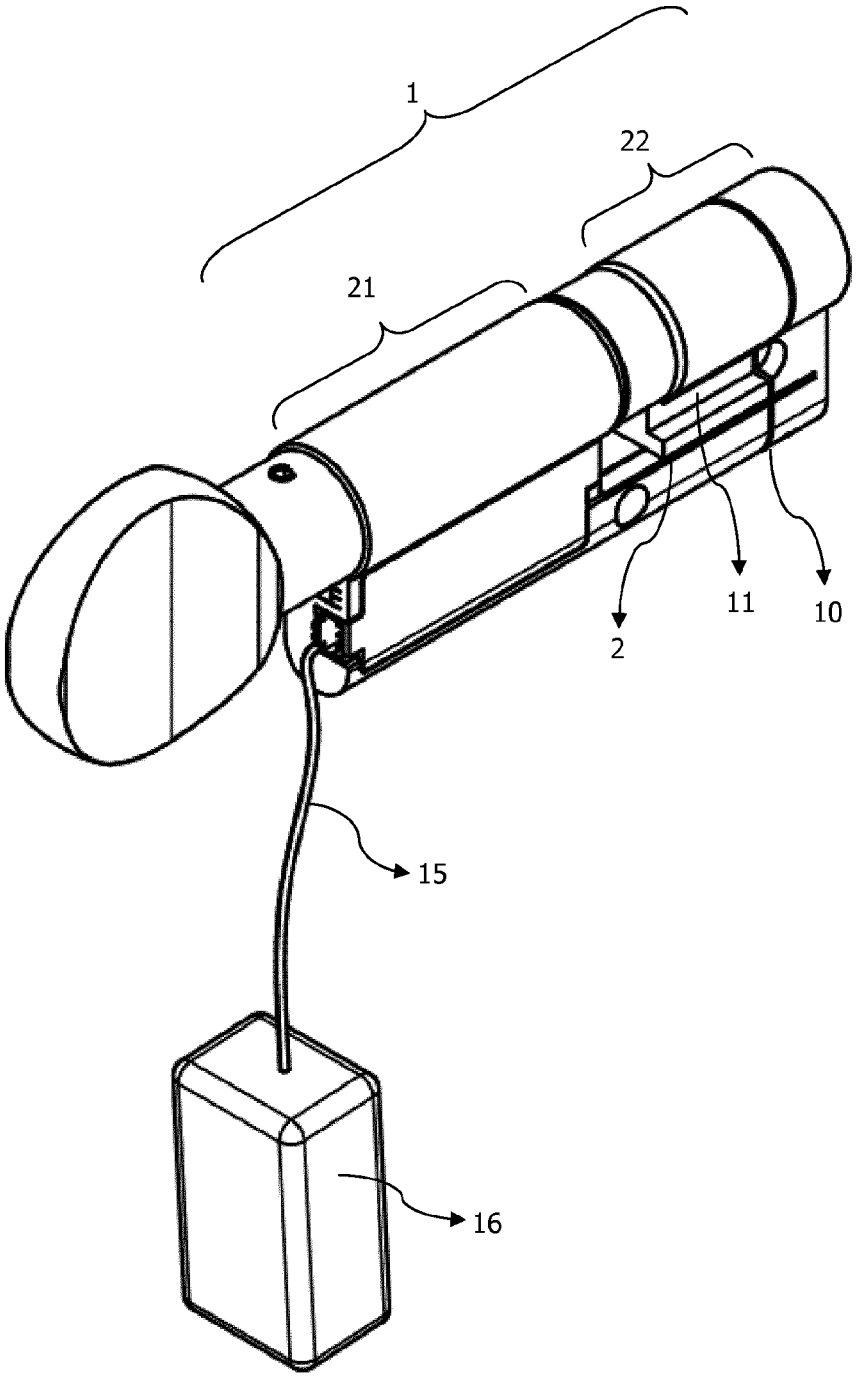
FIG. 6 demonstrates a rear perspective view of a variation of the second embodiment of the cylinder lock according to the present invention.
Figure 7A:
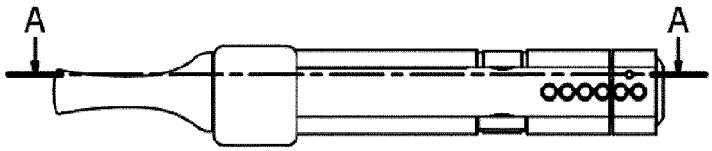
FIG. 7 demonstrates a bottom view (a), a side view (b) and cross-section A-A (c) of the variation of the second embodiment of the cylinder lock according to the present invention.
Figure 7B:
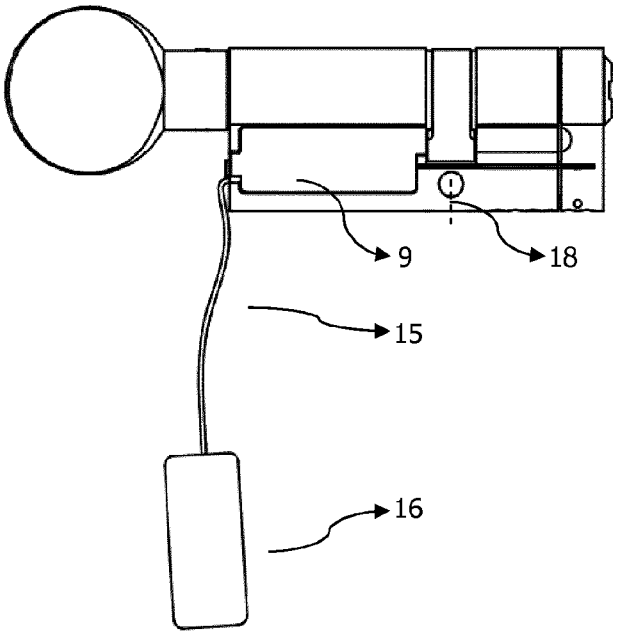
Figure 7C:
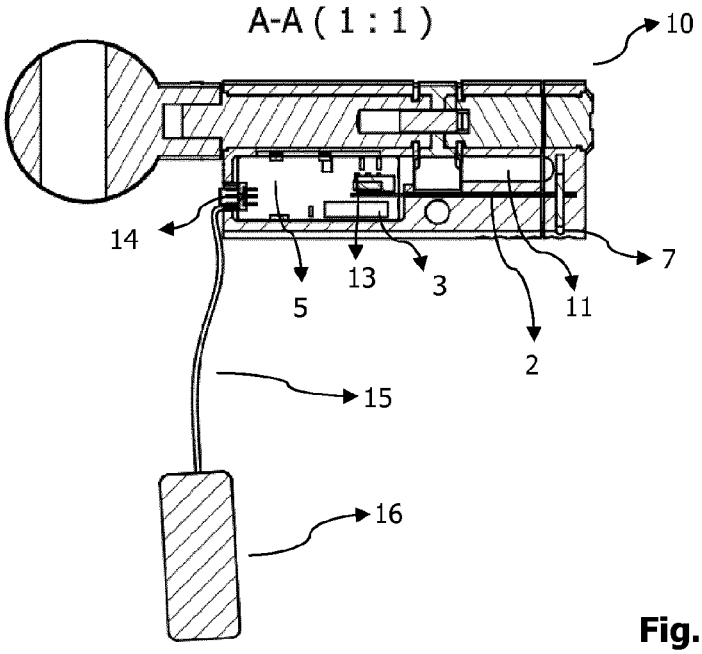

A variation of the second embodiment further comprises an external connection apparatus (16) for mounting to the inner face of the door. As is shown in FIGS. 6 and 7 the external connection apparatus (16) connects through a cable (15) to the connector (14). Data from the electronic circuit board (5) can be transferred to the external elements via cables or wireless means; so that the alarm incorporated cylinder lock can be used in communication with various other peripheral devices such as loudspeakers, fire alarms and closed circuit camera systems etc. Once the alarm is triggered, this data may be conveyed to external peripherals e.g. for the purpose of notifying the police or the house keeper of the lock snapping attempt. This data may be conveyed in many ways through use of wired or wireless communication devices. The connector (14) may additionally be used for establishing connection with an external buzzer who may generate a much higher level of audible noise for alerting the neighborhood. The energy consumed by the external connection apparatus (16) may be supplied either by an external battery or by the mains line.

Figures 8A, 8B:
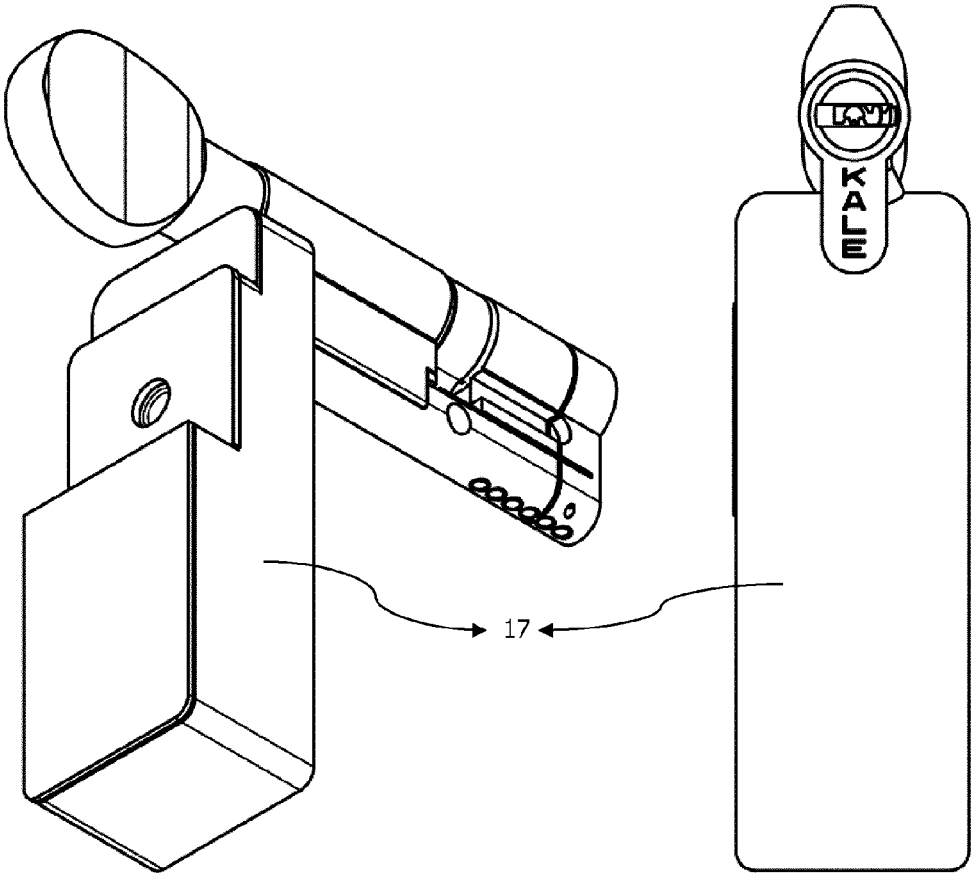
FIG. 8 demonstrates a rear perspective view (a) and a front view (b) of a third embodiment of the cylinder lock according to the present invention.
Figure 9A:
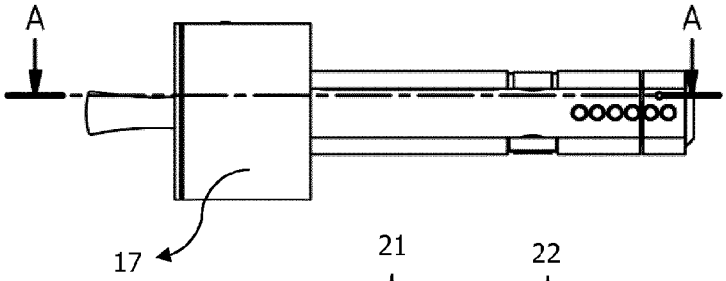
FIG. 9 demonstrates a bottom view (a), a side view (b) and cross-section A-A (c) of the third embodiment of the cylinder lock according to the present invention.
Figure 9B:
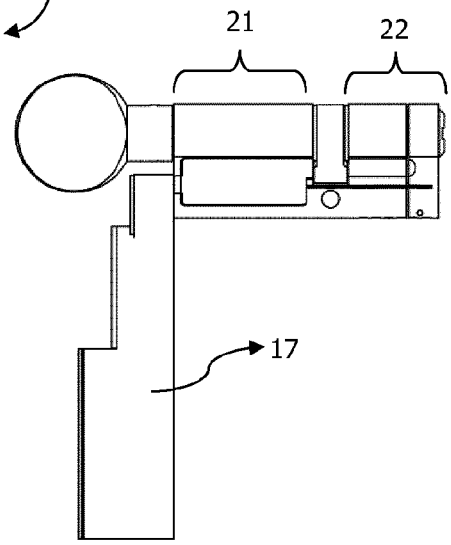
Figure 9C:
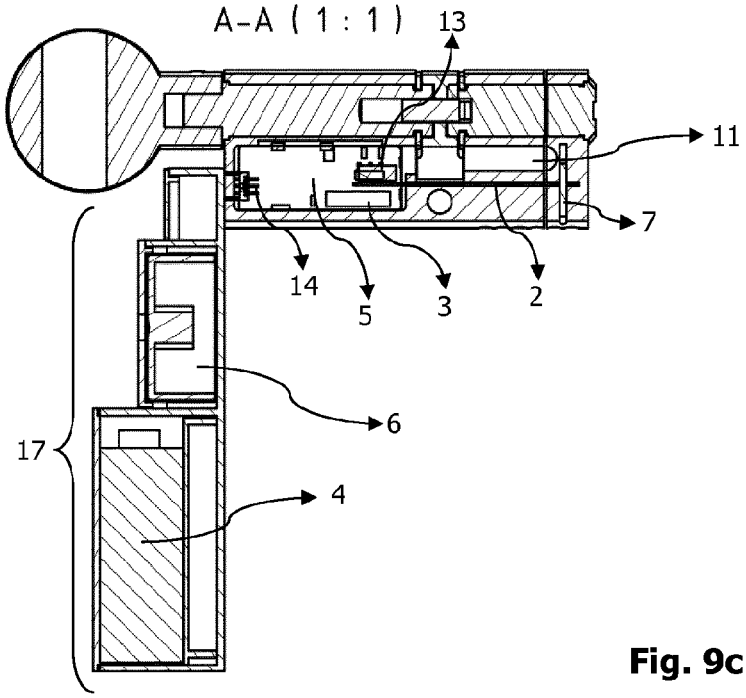
Figure 10A:
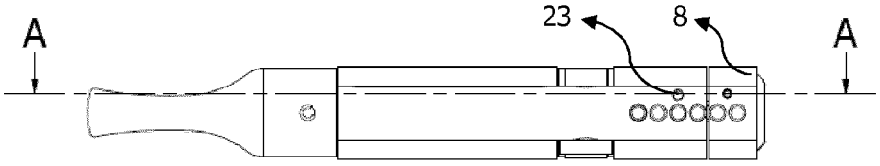
FIGS. 10*a* and 10*b* demonstrates respectively, the bottom and side views of a cylinder lock according to the present invention.
Figure 10B:
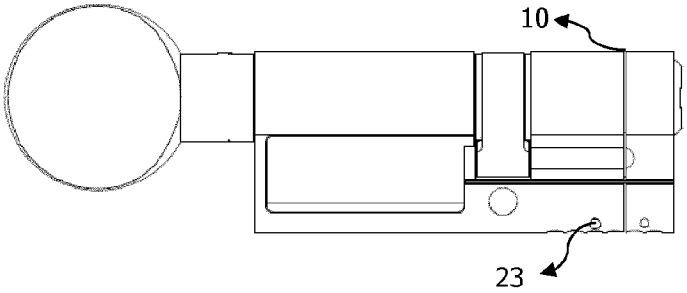
Figure 10C:
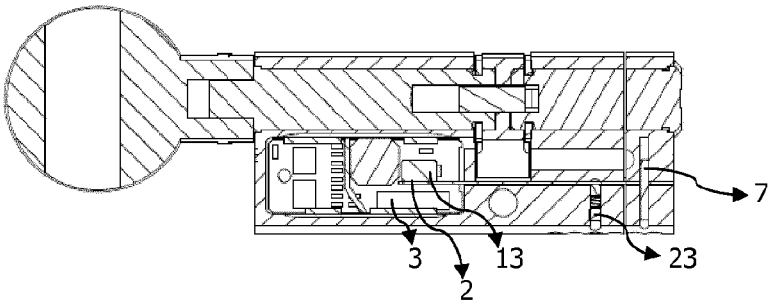
FIG. 10 *c* demonstrates the A-A cross section view of the cylinder lock of FIG. 10*a*.

The alarm incorporated cylinder lock may be equipped with an external buzzer box (17) as shown in FIGS. 8 and 9. The buzzer box (17) may also contain additional battery for energizing a second buzzer or, precautionary, also the electronic circuit board (5) contained in the first cylinder half.

The cylinder lock according to the invention may further comprise, within the second cylinder half (22), a spring loaded block pin (23) for blocking the gap of said rod (2) once the rod (2) slides out of said second cylinder half (22) such that re-insertion of said rod is eliminated. If the gap of the rod remains vacant, it may be possible that the alarm may be de-activated by inserting a thin metal object, or back inserting the same rod (2) itself, into the gap and by filling the gap in between the magnet (13) and the magnetic switch (3). If an object is inserted in between the magnet (13) and the magnetic switch (3), the alarm circuitry may cease to indicate the break-in attempt as the alarm circuitry may be deceived by the inserted object pretending as part of the rod interposed in between the magnet (13) and the magnetic switch (3). Therefore, a spring loaded block pin (23) may conveniently be used for blocking the gap of the rod (2) within the second cylinder half (22) and thereby preventing insertion of an object in between the magnet (13) and the magnetic switch (3). The block pin (23) may be employed in any of the embodiments outlined so far in this text.

The invention claimed is:

1. A cylinder lock (1) having a first cylinder half (21), which in use, is mounted on the indoor side and a second cylinder half (22), which in use, is mounted on the outdoor side of a door, said cylinder lock further comprising, a notch (10) cut out on the outdoor end of the second cylinder half (22) for forming a breakable tip portion (8) on said second cylinder half, a rod (2) which extends along the second cylinder half (22) and enters, partly at its first end, in said first cylinder half (21) and which is secured, at its second end, to said tip portion (8) of said second cylinder half, a volume formed on said first cylinder half (21) accommodating an alarm circuitry including at least an electronic circuit board (5), a magnetic switch (3) and a magnet (13), wherein said first end of the rod (2) is interposed between said magnetic switch (3) and said magnet (13) of the alarm circuitry such that when the tip portion (8) of said second cylinder half (22) breaks apart, said rod (2) slides out of the first cylinder half for detection of a break-in attempt.

2. A cylinder lock (1) according to claim 1, wherein the second cylinder half (22) further comprises a spring loaded block pin (23) for blocking the gap of said rod once the rod (2) slides out of said second cylinder half such that re-insertion of said rod is eliminated.

3. A cylinder lock (1) according to claim 1, wherein the cylinder lock further comprises a buzzer (6) and a battery (4) in the volume of said first cylinder half (21).

4. A cylinder lock (1) according to claim 1, wherein the first cylinder half (21) further comprises a connector (14) in communication with said electronic circuit board (5).

5. A cylinder lock (1) according to claim 4, wherein the cylinder lock further comprises an external connection apparatus (16) connected to said connector (14).

6. A cylinder lock (1) according to claim 4, wherein the cylinder lock further comprises a buzzer box (17) connected to said connector (14).

7. A cylinder lock (1) according to claim 1 wherein the volume formed on said first cylinder half (21) is closed with a cover (9).

8. A cylinder lock (1) according to claim 7 wherein an echo surface (12) is formed on the cover (9).

9. A cylinder lock (1) according to claim 7 wherein a sonic outlet channel (11) is formed on the second cylinder half (22) for conveying the sound waves generated by a buzzer (6) to the outlet of the second cylinder half.

* * * * *